US011959719B2

(12) United States Patent
Dvorak

(10) Patent No.: US 11,959,719 B2
(45) Date of Patent: Apr. 16, 2024

(54) PNEUMATIC SIMULATOR APPARATUS FOR AN OPEN BOLT AUTOMATIC FIREARM

(71) Applicant: Vojtech Dvorak, Tulsa, OK (US)

(72) Inventor: Vojtech Dvorak, Tulsa, OK (US)

( * ) Notice: Subject to any disclaimer, the term of this patent is extended or adjusted under 35 U.S.C. 154(b) by 620 days.

(21) Appl. No.: 17/194,200

(22) Filed: Mar. 5, 2021

(65) Prior Publication Data

US 2022/0018625 A1 Jan. 20, 2022

Related U.S. Application Data

(60) Provisional application No. 63/020,522, filed on May 5, 2020, provisional application No. 62/985,457, filed on Mar. 5, 2020.

(51) Int. Cl.
*F41A 33/06* (2006.01)
*F41A 33/02* (2006.01)

(52) U.S. Cl.
CPC ..... *F41A 33/06* (2013.01); *F41A 33/02* (2013.01)

(58) Field of Classification Search
CPC ..... F41A 33/06; F41A 33/02
See application file for complete search history.

(56) References Cited

U.S. PATENT DOCUMENTS 7,665,396 B1 * 2/2010 Tippmann, Jr. ..... B25C 1/08 89/7
10,054,385 B1 * 8/2018 Dvorak ..... F41A 33/06
10,054,390 B1 * 8/2018 Hane ..... F41A 5/02
11,692,789 B2 * 7/2023 Call ..... F41B 11/55 124/71
2005/0191601 A1 * 9/2005 Dvorak ..... G09B 19/0038 434/16
2012/0129136 A1 * 5/2012 Dvorak ..... F41A 33/06 434/18
2014/0076151 A1 * 3/2014 Kramer ..... F41A 5/26 89/193

(Continued)

*Primary Examiner* — Jeffrey S Vanderveen
(74) *Attorney, Agent, or Firm* — Scott R. Zingerman; David G. Woodral; James F. Lea

(57) ABSTRACT

Pneumatic simulator for an open bolt firearm including an actuator group having a stationary piston and a moving bolt. With each simulated firing cycle producing a firing event, the spring actuates moving bolt toward stationary piston such that the activator unseats a valve located in the stationary piston. Unseating the valve allows regulated compressed gas to exit a high pressure reservoir located in the firearm magazine well which drives the moving bolt back against the spring to complete a firing cycle. Subsequent firing cycles will continue automatically as long as the shooter keeps the trigger depressed. A tension rod, and laser also may comprise the simulator assembly. A nut may be used to secure the tension rod and laser. A laser cable may be used to electrically connect laser to a firing event signal generator. The firing event signal generator may include a magnet located in the moving bolt and a pickup positioned in the stationary piston. With each firing event, the magnet is moved adjacent the pickup which evidences a firing event which generates a signal from the pickup to the laser over the laser cable. The laser then generates a pulse of light which strikes a target to mark a point of impact resulting from the firing event.

18 Claims, 3 Drawing Sheets

(56) References Cited

U.S. PATENT DOCUMENTS

| | | | | |
|---|---|---|---|---|
| 2014/0196267 | A1* | 7/2014 | Tiberius | F41A 33/02 29/401.1 |
| 2015/0007804 | A1* | 1/2015 | Tippmann, Jr. | F41B 11/70 124/73 |
| 2015/0226516 | A1* | 8/2015 | Dvorak | F41B 11/62 124/73 |
| 2016/0025442 | A1* | 1/2016 | Mundy | F41A 33/06 434/18 |
| 2016/0076850 | A1* | 3/2016 | Sullivan | F41A 19/12 124/63 |
| 2019/0226792 | A1* | 7/2019 | Dvorak | F41A 19/13 |
| 2019/0383572 | A1* | 12/2019 | Gregorich | F41A 15/14 |
| 2020/0232731 | A1* | 7/2020 | Sharkov | F42B 5/18 |
| 2021/0164742 | A1* | 6/2021 | Snyder | F16F 15/03 |

* cited by examiner

PNEUMATIC SIMULATOR APPARATUS FOR AN OPEN BOLT AUTOMATIC FIREARM

CROSS REFERENCE TO RELATED APPLICATION

This application claims the benefit of U.S. Provisional Application No. 62/985,457 entitled PNEUMATIC SIMULATOR APPARATUS FOR AN OPEN BOLT AUTOMATIC FIREARM filed Mar. 5, 2020, and U.S. Provisional Application No. 63/020,522 entitled PNEUMATIC MACHINE GUN TRAINER CONVERSION filed May 5, 2020, both herein incorporated by reference in their entirety for all purposes.

FIELD OF THE INVENTION

This disclosure relates generally to converting an actual firearm to a firearm simulator and more particularly to converting an open bolt automatic firearm to a firearm simulator.

BACKGROUND OF THE INVENTION

Firearms have been converted into firearm simulators by replacement of parts of the firearm with simulator parts for simulated shooting such that the resultant firearm comprises a combination of actual firearm components and simulated firearm components. The simulated firearm components have included a simulated barrel unit and a simulated magazine unit. The prior simulated magazine units have included a compressed gas container or a connection to an external compressed gas source. The compressed gas is used to provide energy to operate the weapon simulator by actuating valve means in the simulated barrel unit. The compressed gas is conducted from the compressed gas container, or the external compressed gas source to the simulated barrel unit. When actuated, the valve means forces movement of a slide and compression of a recoil spring and subsequent venting. The resulting recoil simulates the feel of actual weapon firing. A laser beam pulse means is responsive to the simulated weapon firing whereby the laser beam pulse means emits a laser beam onto a target. It would be advantageous to improve simulated weapon firing by reducing the number of parts resulting in a reduction of cost, and also a less complex weapon simulator.

An open bolt automatic firearm requires a somewhat modified simulator apparatus in order to convert the automatic weapon (machine gun) into a training weapon which does not use live ammunition. In one such simulator apparatus available from Dvorak Instruments of Tulsa, Oklahoma designed for the FN M249 machine gun, the only original parts removed from the actual firearm include the bolt carrier and magazine. This example simulator apparatus is described in Appendix "A" attached hereto and incorporated fully herein by reference. The simulator apparatus cycles the firearm's firing mechanism exactly as it would during live shooting, while simulating recoil, providing an audible blast and marking the point of impact with a laser. Cycling motion, recoil and blast are arranged by pneumatic means with compressed gas supplied from an external canister/pressure vessel. A tethered gas line supplies compressed gas from the gas supply to the simulated bolt carrier. Batteries are only needed to energize the laser pointer. One drawback of existing simulator systems is the fact that since the automatic firearm, by definition, cycles continuously when the trigger is pulled, a large supply of compressed gas is required from the gas supply. A need, therefore, exists for a pneumatic simulation apparatus for an open bolt automatic firearm wherein the required compressed gas is provided in a manner that simulates ammo storage and feed from the actual firearm.

SUMMARY OF THE INVENTION

The present disclosure includes an apparatus for conversion of an open bolt automatic firearm to a firearm simulator. One purpose of the apparatus of the present disclosure is to quickly and easily convert an open bolt automatic firearm, such as the FN M249 machine gun, into an effective training weapon which does not require live ammunition. Using a pressurized fluid such as compressed gas instead of live ammunition provides the opportunity to fire a large number of simulated rounds at a negligible cost. The only original parts removed from the actual weapon are its bolt carrier and magazine.

In a basic embodiment, the recoil activator of the present disclosure consists of three mating parts: a carriage, piston, and a replacement return spring mounted on a stock return rod from the firearm. Both carriage and piston are preferably made of hardened stainless steel. In an operating position, the piston is stationary and the carriage (or moving bolt) moves back and forth just as a bolt carrier would in the actual weapon. Inside the stationary piston is a pneumatic valve, which opens and shuts during the cycle. The stiffness of the spring inside the valve determines optimal working pressure (meters). The forward motion of the moving bolt activates the valve in the piston, which transfers the hammer's energy to the pneumatic valve. The cyclical rate of the actuator is around 700 rounds per minute, which means about 11 complete stroke cycles per second.

In a preferred arrangement, the pressurized fluid such as compressed air should be without contamination. The working pressure is preferably 800-900 PSI, measured at the air coupling. A High-Pressure Regulator with fine adjustment is highly recommended and enables tuning of the system for optimal performance. Felt recoil and acoustic blast changes with pressure. Pressure settings around 900 PSI usually yield the most desirable deep sound and adequate cycling of the mechanism. The apparatus of the present disclosure can also operate on nitrogen or $CO_2$ gas. There may be a slight difference in performance when using $CO_2$ gas.

The open bolt firearm includes a combination of actual firearm components including a receiver having a magazine well, a barrel and a chamber and a plurality of simulated firing components. The simulated (pneumatic) components include: a stationary piston including a valve; a moving bolt in at least intermittent engagement with the stationary bolt; and, a self-contained magazine including a limited capacity reservoir to receive and sealingly store a pressurized fluid The stationary piston is in fluid communication with the magazine and sealed by the valve. The stationary piston is preferably positioned adjacent the chamber and preferably includes a shoulder which extends into the chamber. In one embodiment, a tension rod is threaded into the stationary piston on one end, inserted through the firearm barrel and secured on its other end by a nut to prevent the stationary piston from moving within or out of the firearm chamber.

The magazine is preferably adapted to engage and be retained in the magazine well. The stationary bolt is preferably adapted to receive pressurized fluid from the reservoir in the magazine. The magazine may include a pressure regulator between the reservoir and the stationary bolt. The magazine preferably includes a fill port for receiving pressurized fluid from a supply source. The magazine may include a shot counter such that the magazine shuts off the supply of pressurized fluid once a preprogrammed number of shots are fired.

An activator displaces the valve to allow the pressurized fluid to initiate movement of the moving bolt. In one embodiment, the moving bolt includes the activator. In an alternate embodiment, the stationary bold includes the activator. In this embodiment, the metering valve is preferably a poppet valve. The activator releases the pressurized fluid from the reservoir to simulate firing of the firearm.

The moving bolt is adapted for movement, and preferably reciprocating movement, within the receiver. The moving bolt preferably includes a cavity for receiving at least a portion of the stationary piston. The stationary bolt is sized and shaped to closely mate the cavity with minimal or no gap. The moving bolt may include the activator in the cavity The valve is preferably a metering valve and pressurized fluid is released by the activator displacing the valve to allow a metered volume of pressurized fluid to initiate reciprocation of the moving bolt.

A biasing member urges the moving bolt into at least intermittent engagement with the stationary piston. In the preferred embodiment, the biasing member is a spring and particularly a recoil spring and recoil rod.

In an alternate embodiment, the magazine emulates an ammo box providing pressured gas to the apparatus through a flexible hose including fittings connected to the stationary piston. In another embodiment, the magazine emulates an ammo box providing pressured gas to the apparatus through a plate feeding into the ammo tray of the firearm; said plate instantly mating with a nipple on said stationary piston.

The apparatus of the present disclosure cycles the weapon's firing mechanism exactly as it would during live firing using live ammunition, while simulating recoil, providing an audible simulated impulse (gunshot), and identifying a simulated point of impact. Cycling motion, recoil and impulse are derived purely by pneumatic means. A power supply, which may be provided through a cable or from batteries located in or on the simulator apparatus such as the simulator magazine may be used to energize a shot counter, laser pointer, or other point of impact indicator. The trigger feel is preferably not altered from the actual weapon since the actual trigger group is retained for the simulation. In this way the shooter can practice with the real trigger. Each "firing" cycle is initiated by the strike of the unmodified hammer and supports full-auto firing of the firearm/weapon. Cyclic rate of the system is approximately 11 rounds per second or 700 rounds per minute when operated at approximately 900 PSI.

With each firing event, a magnet is moved adjacent a pickup which evidences a firing event which generates a signal from the pickup to a laser over the laser cable. The laser then generates a pulse of light which strikes a target to mark a point of impact resulting from the firing event.

All components of the simulator apparatus of the present disclosure are made of stainless materials and will not rust. After a training session, the simulator assembly can be quickly removed from the firearm without special tools, making the weapon immediately available again for use with live ammunition.

DETAILED DESCRIPTION OF THE PREFERRED EMBODIMENTS

Figure 1:
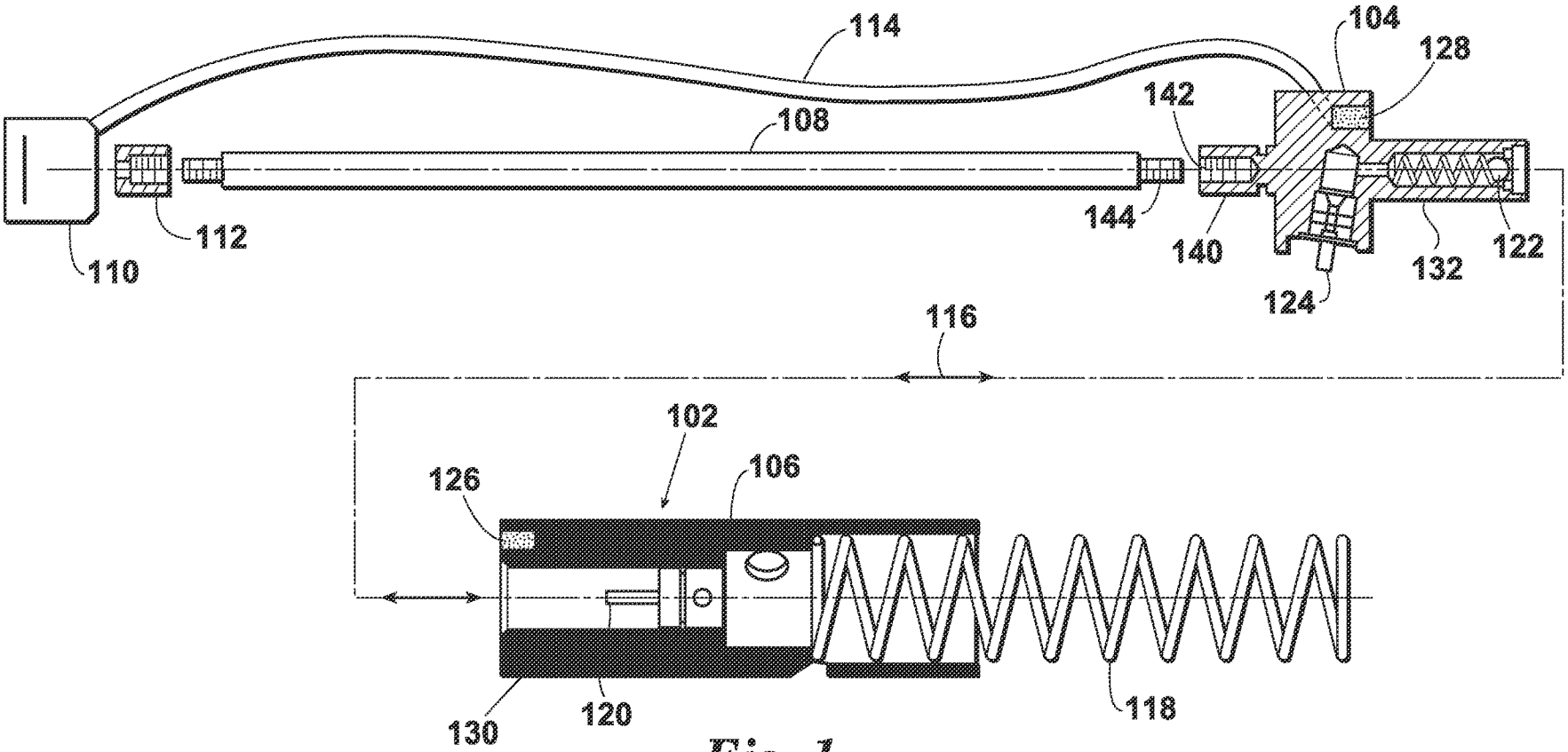
FIG. 1 is a cut-away exploded side view of the activator group of the pneumatic simulator for an open bold automatic firearm of the present disclosure.

FIG. 1 is a cut-away exploded side view of the actuator group 102 of the pneumatic simulator for an open bold automatic firearm of the present disclosure. Actuator group 102 includes, generally, a stationary piston 104 and a moving bolt 106. A tension rod 108, and laser 110 also may comprise the simulator assembly. A nut 112 may be used to secure tension rod 108 and laser 110.

Stationary piston 104 is in fluid communication with the reservoir 202 of magazine 200 (FIG. 2) and sealed by 122 valve. Stationary piston 104 is preferably positioned adjacent the chamber of the firearm and preferably includes a shoulder 140 which extends into the chamber. In one embodiment, a tension rod 108 is threaded into a threaded cavity 142 in stationary piston 104 on one end of tension rod 108. Tension rod 108 is inserted through the firearm barrel and secured on its other end by a nut 112 to prevent stationary piston 104 from moving within or out of the firearm chamber.

An activator 120 displaces valve 122 to allow the pressurized fluid to initiate movement (reciprocation) of the moving bolt 106. In the preferred embodiment, moving bolt 106 includes activator 120. The activator 120 releases pressurized fluid from the reservoir (described below) to simulate firing of the firearm.

Moving bolt 106 is adapted for movement, and preferably reciprocating movement, within the firearm receiver. Moving bolt 106 preferably includes a cavity 130 for receiving at least a portion 132 of stationary piston 104. Stationary piston 104 is sized and shaped to closely mate cavity 130 with minimal or no gap. Moving bolt 106 may include the activator 120 in cavity 130. Valve 122 is preferably a metering valve and pressurized fluid is released by activator 120 displacing valve 122 to allow a metered volume of pressurized fluid to initiate reciprocation of moving bolt 106.

A laser cable 114 may be used to electrically connect laser 110 to a firing event signal generator 116. In one embodiment, firing event signal generator 116 includes a magnet 126 located in moving bolt 106 and a pickup 128 positioned in stationary piston 104. With each simulated firing cycle producing a firing event, spring 118 actuates moving bolt 106 toward stationary piston 104 such that activator 120 unseats valve 122 located in stationary piston 104. Unseating valve 122 allows regulated compressed gas to exit high pressure reservoir 202 within magazine 200 which drives moving bolt 106 back against spring 118 to complete a firing cycle. Subsequent firing cycles will continue automatically as long as the shooter keeps the trigger depressed. With each firing event, magnet 126 is moved adjacent pickup 128 which evidences a firing event which generates a signal from pickup 128 to laser 110 over laser cable 114. Laser 110 then generates a pulse of light which strikes a target to mark a point of impact resulting from the firing event. Each firing event may be counted and recorded.

Figure 2:
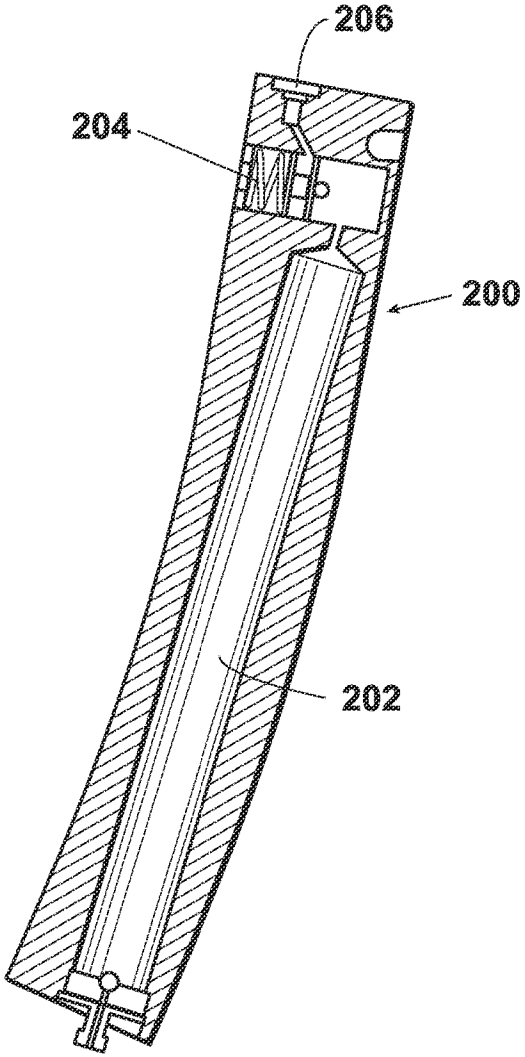
FIG. 2 is a cut-away side view of a first embodiment of a magazine including a compressed gas (such as compressed air) reservoir and pressure regulator of the pneumatic simulator of the present disclosure.

FIG. 2 is a cut-away side view of a first embodiment of magazine 200 including a compressed gas (such as compressed air) reservoir 202 and pressure regulator 204 of the pneumatic simulator of the present disclosure.

Figure 3:
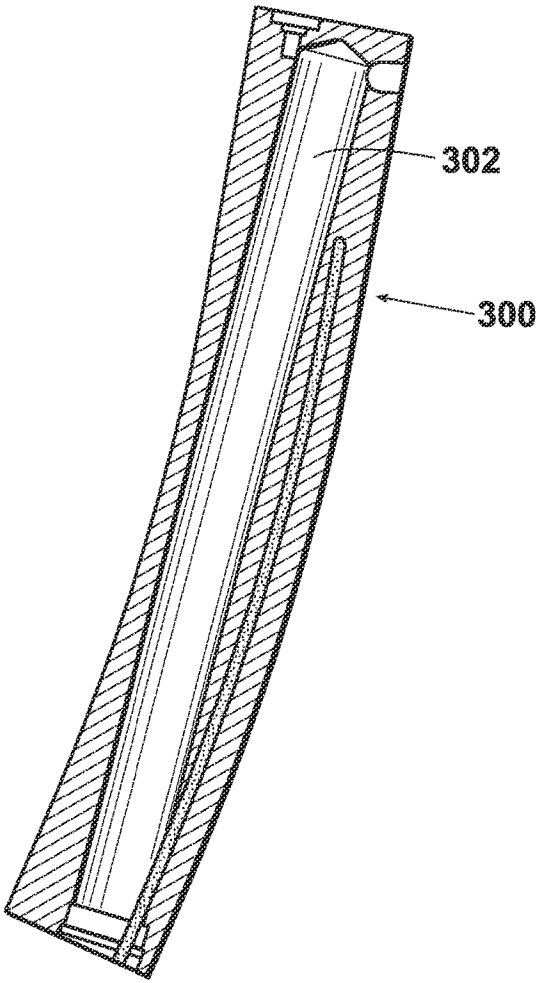
FIG. 3 is a cut-away side view of a second embodiment of a magazine including a compressed gas ($CO_2$) reservoir of the pneumatic simulator of the present disclosure.

FIG. 3 is a cut-away side view of a second embodiment of a magazine 300 including a compressed gas ($CO_2$) reservoir 302 of the pneumatic simulator of the present disclosure.

Figure 4:
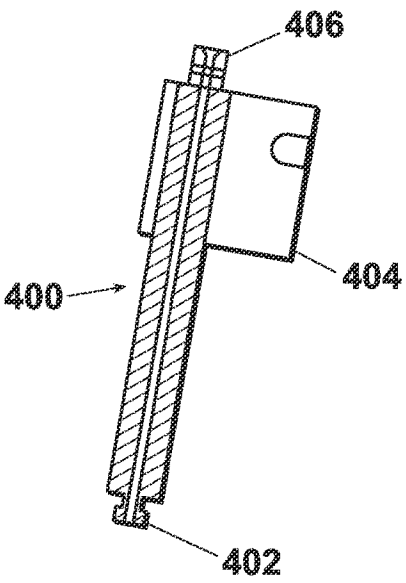
FIG. 4 is a cut-away side view of a third embodiment of a magazine including a gas supply fitting from a remote compressed gas source of the pneumatic simulator of the present disclosure.

FIG. 4 is a cut-away side view of a third embodiment of a magazine 400 including a gas supply fitting 402 from a remote compressed gas source, a locating block 404 to be inserted into the magazine well of the automatic firearm, and a quick connect gas fitting 406 which mates with nipple 124 of stationary piston 104 of FIG. 1 to supply compressed gas thereto.

Figure 5:
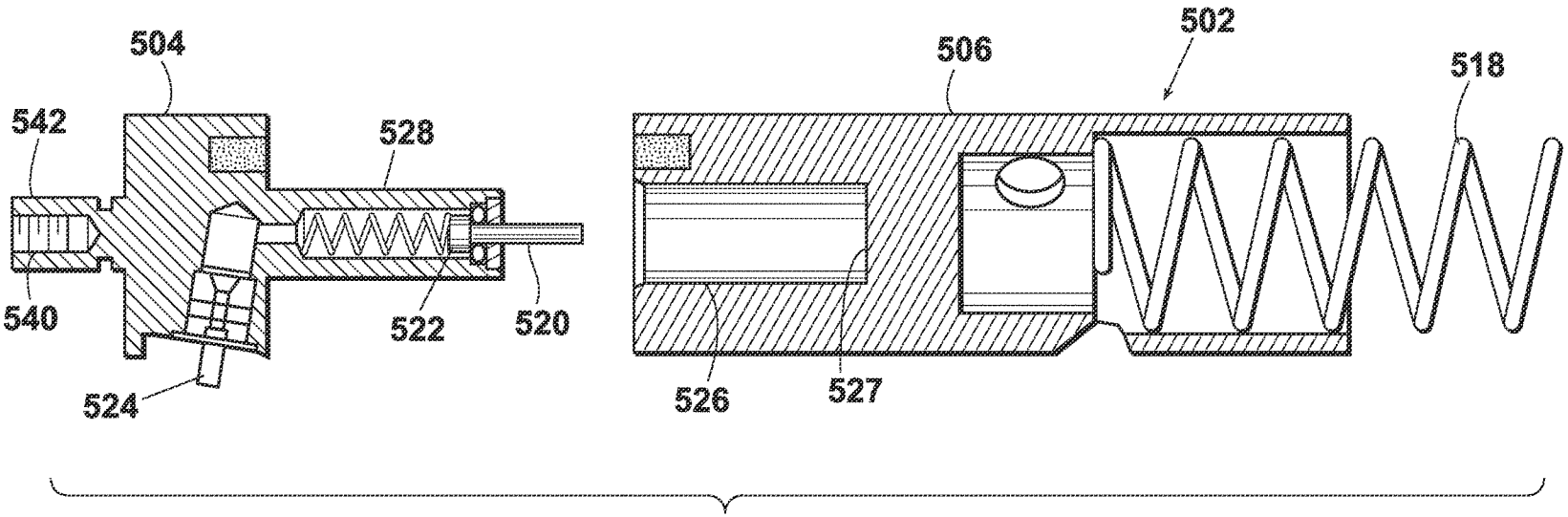
FIG. 5 is a cut-away exploded side view of an alternate embodiment of the stationary piston and moving bolt of the actuator group of FIG. 1.

FIG. 5 is a cut-away exploded side view of an alternate embodiment actuator group 502 including a stationary piston which includes a pin 520 which is a part of valve 522 and actuated by moving bolt 506 to create a firing event as described above.

In this embodiment, the stationary bolt 506 includes the activator 520. In this embodiment, the metering valve 522 is preferably a poppet valve. Activator 520 releases the pressurized fluid from the reservoir 202 of magazine 200 (or reservoir 302 of magazine 300) to simulate firing of the firearm. This occurs when actuator 520 strikes the back 527 of cavity 526.

Figure 6:
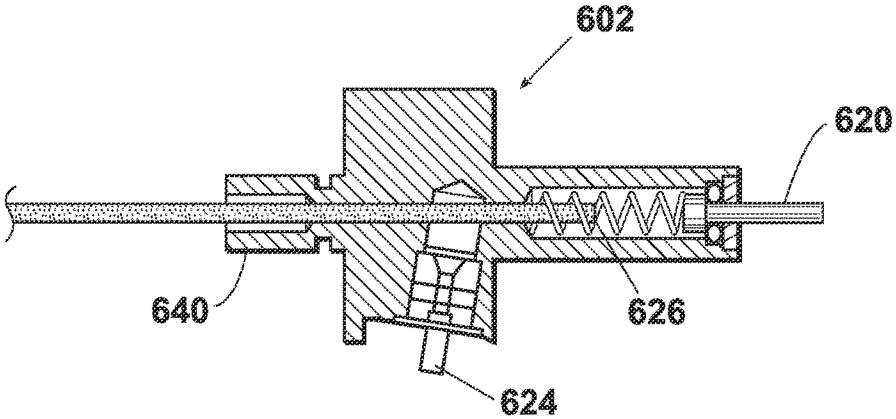
FIG. 6 is a cut-away side view of an alternate embodiment stationary piston of FIG. 1 depicting an alternate embodiment firing event signal generator (shot counter).

FIG. 6 is a cut-away side view of an alternate embodiment stationary piston of FIG. 1 depicting an alternate embodiment firing actuator 602 of the present disclosure.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. An apparatus for non-permanent conversion of an open bolt firearm into a compressed gas powered firearm simulator for simulated shooting, the open bolt firearm including a combination of actual firearm components including a receiver having a magazine well, a barrel and a chamber and a plurality of simulated firing components, the apparatus comprising:

a stationary piston including a valve;

a moving bolt in at least intermittent engagement with said stationary bolt;

said moving bolt adapted for movement within the receiver;

a self-contained magazine including a limited capacity reservoir to receive and sealingly store a pressurized fluid;

said stationary piston in fluid communication with said magazine and sealed by said valve.

2. The apparatus of claim 1 further including an activator for displacing said valve to allow said pressurized fluid to initiate movement of said moving bolt.

3. The apparatus of claim 2 wherein said moving bolt includes said activator.

4. The apparatus of claim 2 wherein said stationary bold includes said activator.

5. The apparatus of claim 1 further including a biasing member for urging said moving bolt in said at least intermittent engagement with said stationary piston.

6. The apparatus of claim 5 wherein said biasing member is a spring.

7. The apparatus of claim 1 wherein said magazine is adapted to engage and be retained in the magazine well.

8. The apparatus of claim 1 wherein the assembly includes a laser activated by a mechanical or magnetic limit switch.

9. An apparatus for conversion of an open bolt firearm into a compressed gas powered firearm simulator for simulated firing, the open bolt firearm including a combination of actual firearm components including a receiver having a magazine well, a barrel, a chamber and a plurality of simulated firing components, the apparatus comprising:

a stationary piston including a valve;

said stationary piston positioned adjacent the chamber;

a moving bolt adapted for reciprocating movement within the receiver;

a self-contained magazine adapted to engage and be retained in the magazine well;

said magazine including a limited capacity reservoir adapted to receive and sealingly store a pressurized fluid;

said stationary piston adapted to receive said pressurized fluid from said magazine;

an activator for releasing said pressurized fluid from said reservoir to simulate firing of the firearm.

10. The apparatus of claim 9 wherein said moving bolt includes a cavity for receiving at least a portion of said stationary piston.

11. The apparatus of claim 10 wherein said valve is a metering valve and said pressurized fluid is released by said activator displacing said valve to allow a metered volume of said pressurized fluid to initiate reciprocation of said moving bolt.

12. The apparatus of claim 11 wherein said moving bold includes said activator in said cavity.

13. The apparatus of claim 11 wherein said stationary bolt includes said activator.

14. The apparatus of claim 13 wherein said metering valve is a poppet valve.

15. The apparatus of claim 9 wherein said magazine includes a pressure regulator between said reservoir and said stationary bolt.

16. The apparatus of claim 9 wherein said magazine includes a fill port for receiving pressurized fluid from a supply source.

17. The apparatus of claim 9 wherein said magazine emulates an ammo box providing pressured gas to the apparatus through a flexible hose including fittings connected to the stationary piston.

18. The apparatus of claim 9 wherein said magazine emulates an ammo box providing pressured gas to the apparatus through a plate feeding into the ammo tray of the firearm; said plate instantly mating with a nipple on said stationary piston.

* * * * *